US005819985A

United States Patent [19]

Brody

[11] Patent Number: 5,819,985

[45] Date of Patent: Oct. 13, 1998

[54] SPRAY CAN ACTUATOR WITH ENHANCED ATTACHMENT MECHANISM

[75] Inventor: Harvey Brody, Costa Mesa, Calif.

[73] Assignee: Delshar Industries, INc., Santa Ana, Calif.

[21] Appl. No.: 786,726

[22] Filed: Jan. 27, 1997

[51] Int. Cl.[6] ..... B67D 5/32

[52] U.S. Cl. ..... 222/153.09; 222/402.15

[58] Field of Search ..... 222/174, 402.15, 222/323, 473, 474, 153.09

[56] References Cited

U.S. PATENT DOCUMENTS

| | | | |
|---|---|---|---|
| 2,877,934 | 3/1959 | Wallace | 222/323 |
| 3,172,582 | 3/1965 | Belpedio | 222/473 |
| 3,189,232 | 6/1965 | Joffe | 222/394 |
| 3,229,859 | 1/1966 | Conroy et al. | 222/402.15 |
| 3,734,357 | 5/1973 | Batistelli et al. | 222/474 |
| 4,089,440 | 5/1978 | Lee | 222/174 |
| 4,401,240 | 8/1983 | Brack | 222/474 |
| 4,432,474 | 2/1984 | Hutchinson et al. | 222/474 |
| 4,805,812 | 2/1989 | Brody | 222/402 |
| 5,086,954 | 2/1992 | Brody | 222/402.11 |
| 5,323,937 | 6/1994 | Brody | 222/402.15 |

FOREIGN PATENT DOCUMENTS

| | | |
|---|---|---|
| 1163978 | 9/1969 | United Kingdom . |
| 1343881 | 1/1974 | United Kingdom . |
| 1487719 | 10/1977 | United Kingdom . |
| 2001706 | 2/1979 | United Kingdom . |

*Primary Examiner*—Philippe Derakshani
*Attorney, Agent, or Firm*—Klein & Szekeres, LLP

[57] ABSTRACT

A spray can holding and actuation device comprises a rim engagement element and a mechanism for compressing the rim engagement element against the rim surrounding the push-button valve on the can to attach the device to the rim. In a preferred embodiment, the compressing mechanism comprises a locking element that is selectively movable to a locking position in which it compresses the rim engagement element into a locking attachment to the rim. More specifically, the rim engagement element comprises a pair of opposed segments that together define a substantially annular interior surface that fits loosely around the exterior of the rim, and the locking element comprises a substantially annular member that is movable into and out of a compressing engagement with the exterior surface of the rim engagement element segments. As the locking element is moved into the compressing engagement with the segments, it presses them toward each other into a clamping engagement with the rim. When the locking element is moved out of the compressing engagement with the segments, the segments resiliently restore themselves to their original positions, whereby the rim engagement element can easily be separated from the rim. The rim engagement element may advantageously be provided with camming surfaces on its exterior surface to enhance and facilitate the pressing action provided by the locking element.

34 Claims, 4 Drawing Sheets

FIG. 1
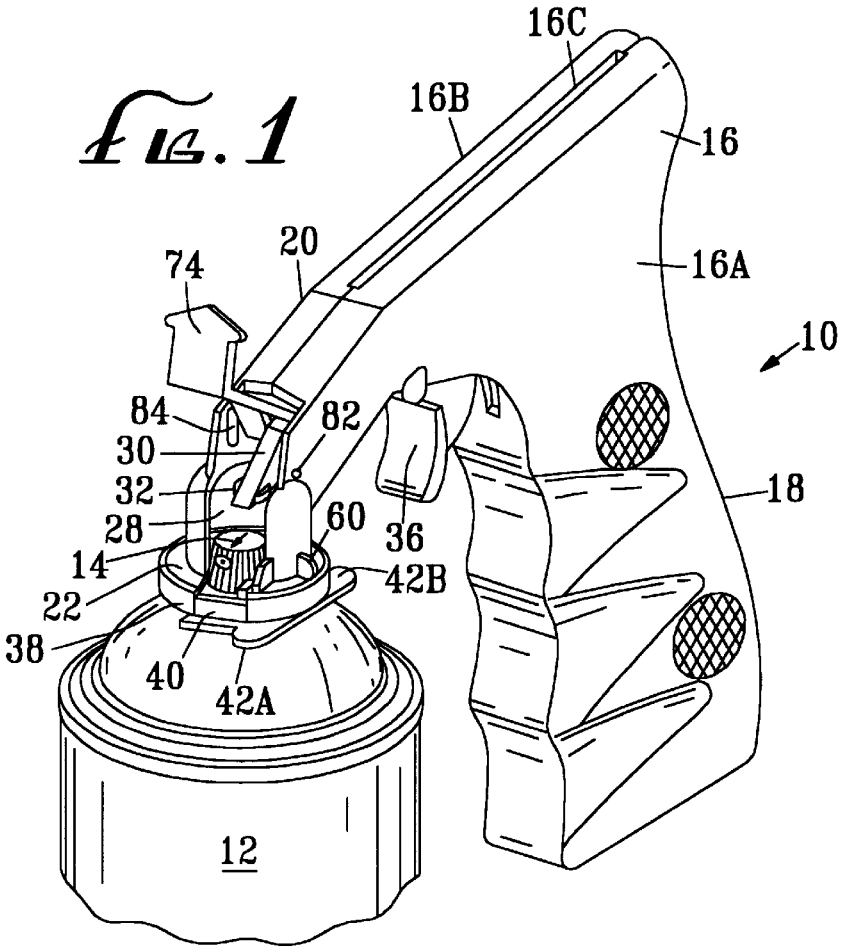
FIG. 2
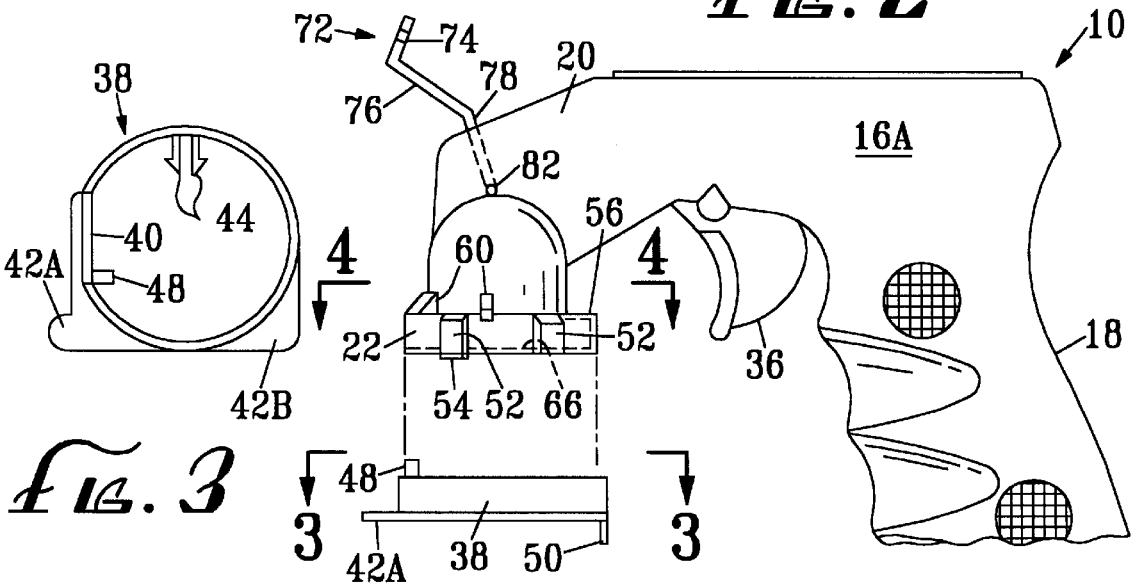
FIG. 3

SPRAY CAN ACTUATOR WITH ENHANCED ATTACHMENT MECHANISM

RELATED PATENT DISCLOSURE

The subject matter of this application is related to that of applicant's prior U.S. Pat. No. 5,086,954, the disclosure of which is incorporated herein by reference.

BACKGROUND OF THE INVENTION

The present invention relates to a device for both holding a pressurized container, such as an aerosol spray can, and for actuating the valve of the container to dispense its pressurized contents. Specifically, the present invention relates to an improvement in the mechanism by means of which these devices are attachable to such containers.

Spray can holding and actuation devices are well known in the art, as exemplified by the following U.S. Pat. Nos.: 2,877,934—Wallace; 3,172,582—Belpedio; 3,189,232—Joffe, and, 4,089,440—Lee. Further examples of such devices are disclosed in the following United Kingdom patent specifications: 1,163,978; 1,343,881; 1,487,719; 2,001,706 (published application); and 2,038,952 (published application).

One of the most popular types of spray can actuation devices has the general configuration of a pistol, as exemplified in the following U.S. Pat. Nos.: 4,432,474—Hutchinson et al.; 4,805,812—Brody; 5,086,954—Brody; and 5,323,937—Brody. These devices typically include a body having a pistol grip handle, and means on the front of the body for removable attachment to the top of a spray can, the latter having a push-button spray valve. The body carries a valve actuation member that is operatively connected to a trigger, the latter being located with respect to the handle in a position analogous to that of a pistol trigger. The linkage between the trigger and the valve actuation member causes the actuation member to be brought into operable engagement with the valve when the trigger is squeezed, thereby actuating the valve to dispense the container's contents.

The devices disclosed in the above-referenced patents to Brody add to this structure a mechanism for disabling or locking the valve actuation mechanism. Further improvements, disclosed and claimed in U.S. Pat. Nos. 5,086,954—Brody and 5,323,937—Brody, relate to the structure of the device that provides for the attachment of the device to a spray can by engagement with the channel that typically surrounds the valve.

While many of the prior art devices, and particularly those disclosed in the aforementioned patents to Brody, have achieved commercial success, further improvements have been sought to increase the utility and improve the performance of the available spray can holding and actuation devices. Specifically, a stronger and more secure can attachment structure than is currently available has been sought to accommodate the use of these devices to larger, heavier spray cans.

One approach to the problem of providing more secure can attachment is shown in FIG. 10 of the drawings accompanying the instant specification. In this approach, a spray can holding and actuation device 100, of the type generally described in the above-mentioned patents to Brody, has a generally pistol-shaped body 102 with a downwardly and forwardly extending front portion 104 that is adapted for attachment to a typical spray can 106 having a push-button valve 108 surrounded by an annular rim 110. The front portion 104 of the device 100 is provided with a can retention member in the form of a split ring, comprising first and second ring halves 112*a*, 112*b* attached at the rear by a hinge (not shown). The free end of the first ring half 112*a* has a slot 116, and the free end of the second ring half 112*b* is provided with a finger or protuberance 118 that is received in the slot 116 to secure the ring halves 112*a*, 112*b* together when they are placed around the rim 110. To provide adequate stabilization of the can 106, the first ring half 112*b* is provided with a slotted tab 120 approximately 90° from end slot 116, and this slotted tab 120 receives a projection 122 that extends laterally from the front portion 104 of the body 102.

While the above-described approach has provided satisfactory results in many applications, it has proved somewhat complex and expensive to manufacture, and there remain some problems with the stability and security of the can attachment, especially with larger and heavier cans.

Thus, there is a need for a more secure attachment mechanism for use with larger, heavier cans, and for an attachment mechanism that is simpler and more economical to manufacture than has heretofore been available.

SUMMARY OF THE INVENTION

Broadly, the present invention is an improved aerosol spray can holding and actuation device (of the type generally exemplified by U.S. Pat. Nos. 4,805,812—Brody; 5,086,954—Brody; and 5,323,937—Brody), wherein the improvement comprises a rim engagement element and a mechanism for compressing the rim engagement element against the rim surrounding the push-button valve on the can to effect a secure attachment between the rim engagement element and the rim. In a preferred embodiment, the compressing mechanism comprises a locking element that is selectively movable to a locking position in which it compresses the rim engagement element into a locking attachment to the rim. More specifically, the rim engagement element of the present invention comprises an opposed pair of ring engagement segments that define a substantially annular interior surface dimensioned to fit loosely around the exterior of the rim, and the locking element comprises a substantially annular member that is movable into and out of a compressing engagement with the exterior surface of the rim engagement segments. As the locking element is moved into the compressing engagement with the rim engagement segments, it presses them toward each other into a clamping engagement with the rim. When the locking element is moved out of the compressing engagement with the rim engagement segments, they resiliently restore themselves to their original positions, whereby the rim engagement element can easily be separated from the rim. The rim engagement element may advantageously be provided with camming surfaces on its exterior surface to enhance and facilitate the clamping action provided by the locking element.

As will be more fully appreciated from the detailed description below, the present invention provides a secure attachment of the spray can holding and actuation device to a spray can, even if the can is quite heavy. Moreover, the present invention provides a significant enhancement that can be readily achieved using conventional injection molding techniques, and thus can easily be incorporated into existing spray can holding and actuation devices. Furthermore, the present invention can be included in such devices with little additional cost.

BRIEF DESCRIPTION OF THE DRAWINGS

FIG. 1 is a perspective view of a spray can holding and actuation device incorporating the improvements of the present invention, showing the device attached to a typical spray can;

FIG. 2 is a left side elevational view of the device, showing an exploded view of the components of the improved attachment mechanism of the present invention;

FIG. 3 is a cross-sectional view taken along line 3—3 of FIG. 2;

DETAILED DESCRIPTION OF A PREFERRED EMBODIMENT

Figure 4:
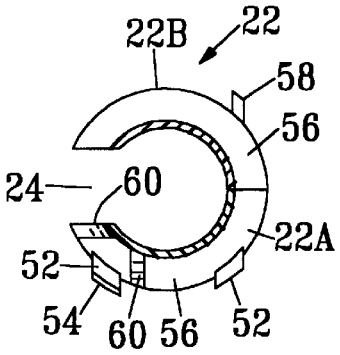
FIG. 4 is a cross-sectional view taken along line 4—4 of FIG. 2.
Figure 6:
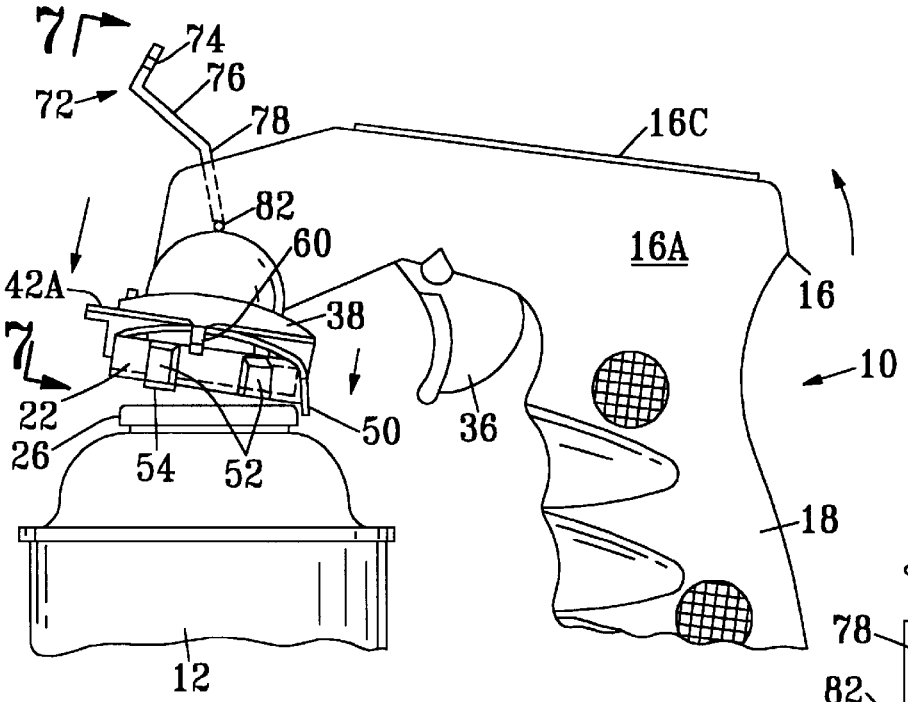
FIG. 6 is a left side elevational view of the device, showing the device in the process of being attached to a spray can.
Figure 9:
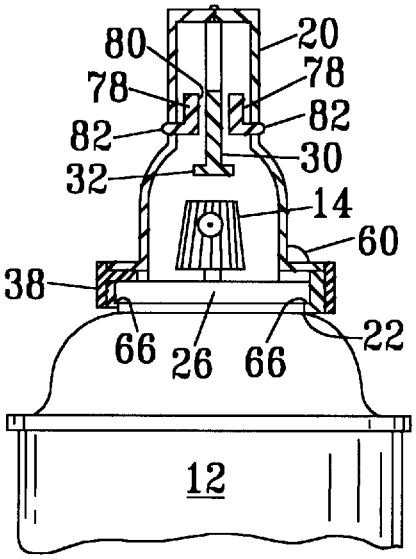
FIG. 9 is a cross-sectional view taken along line 9—9 of FIG. 8.

Referring now to the drawings, FIG. 1 shows an improved actuation and holding device 10, in accordance with the preferred embodiment of the present invention, attached to a pressurized container or can 12, having a push-button spray valve 14. The actuation and holding device 10 has a body 16 that would typically be made of molded plastic by conventional techniques, well-known in the art, such as the "butterfly" injection molding method. The body 16 includes a pistol grip handle 18 and a forward portion 20 that extends in a generally downward direction, terminating in a generally annular rim engagement element 22, interrupted in the front by a gap 24 (best shown in FIG. 4). As best shown in FIGS. 6 and 9, the rim engagement element 22 is internally dimensioned to fit around the exterior of an annular rim 26 formed in the top of the pressurized container 12, around the push-button valve 14.

The body 16 of the device 10 is formed by the butterfly molding method. Thus, the body 16 is initially formed in two axial or longitudinal halves 16*a* and 16*b*, joined along a longitudinal integral hinge 16*c*, along which the body halves 16*a*, 16*b* are folded together. The rim engagement element 22 is therefore also longitudinally divided into two segments 22*a*, 22*b* that are respectively integral with the body halves 16*a*, 16*b*. The rim engagement element segments 22*a*, 22*b* abut together at the rear, diametrically opposite the frontal gap 24. The body halves 16*a*, 16*b* are attached to one another by some conventional attachment mechanism, such as one or more pin and socket arrangements (not shown), in the pistol grip handle 18. There is, however, no such attachment between the body halves 16*a*, 16*b* in the front portion 20, for reasons that will be explained below.

A substantially rectangular opening 28 in the front of the body 16, above the rim engagement element 22, is defined on the sides and top by the wall surfaces of the forward portion 20 of the body 16. The contents of the container 12 are dispensed from the valve 14 through the opening 28.

The device 10 includes a valve actuation member comprising a lever 30 disposed longitudinally within the body 16. The lever 30 has a first or free end which extends through the forward portion 20 of the body 16 and into the opening 28, thereby being disposed just above the valve 14. The free end terminates in a laterally-extended surface in the form of a flattened disk 32 that provides a flat, substantially circular surface for effecting a positive engagement with the valve 14, as described below. The other end of the lever 30 extends through an opening in the underside of the body 16 and is configured in the shape of a trigger 36. The actuation lever 30 pivots on a pin (not shown) when the trigger 36 is pressed toward the handle 18, thereby causing the free end to pivot downwardly to bring the disk 32 into operative engagement against valve 14. In this manner, the valve 14 is depressed to dispense the contents of the container 12. The actuation lever 30 may include a resilient, rearwardly-extending extension (not shown) that engages an interior surface of the body 16, and that acts as a spring to assist the return of the lever 30 to its original position when the trigger 36 is released. In this original position, the free end of the lever 30 is out of engagement with the valve 14, as shown in FIG. 1.

As shown in FIGS. 2 through 9, the attachment mechanism of the present invention comprises the rim engagement element 22 and a locking element or locking ring 38. The locking ring 38 is a substantially annular element that fits concentrically around the outside of the rim engagement element 22, and therefore has an inside diameter that is slightly larger than the outside diameter of the rim engagement element 22. As will be more fully described below, the locking ring 38 is movable between a first, or released, position, in which it is not in a compressing engagement with the rim engagement element 22, and a second, or locking, position in which it compressively engages the rim engagement element 22.

Figure 5:
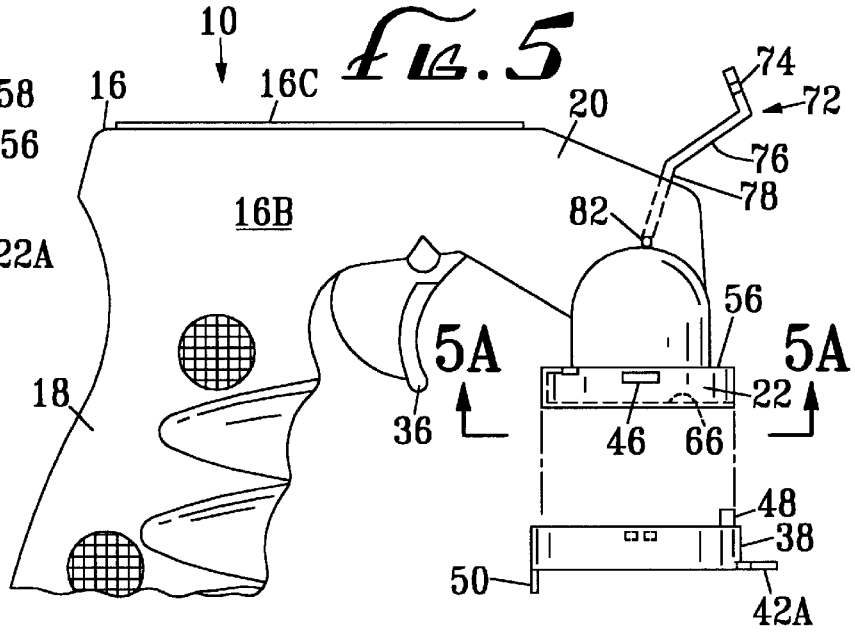
FIG. 5 is a right side elevational view of the device, showing an exploded view of the components of the improved attachment mechanism of the present invention.

The rim engagement element 22 and the locking ring 38 are best shown in FIGS. 2 through 6. Referring first to FIG. 3, the locking ring 38 has a substantially straight portion 40 that may be called the "front" section, and that registers with the opening 28 in the front portion 20 of the body 16 when the locking ring 38 is in its locked position, as shown in FIG. 1. The locking ring 38 includes at least one, and preferably two, horizontal tabs 42*a*, 42*b*, extending forwardly and rearwardly, respectively, that facilitate the movement of the locking ring 38 between the aforementioned first and second positions. Extending inwardly from the interior wall surface of the locking ring 38, approximately 90° from the front section 40, is an anti-rotation element, preferably in the form of a pair of flexible prongs 44. The prongs 44 are dimensioned and located so as to be received in a horizontal aperture or slot 46 in the peripheral wall of the rim engagement element 22 (FIG. 5). When the prongs 44 are inserted into the aperture or slot 46, the locking ring 38 may not be rotated relative to the rim engagement element 22. A locking plate engagement finger 48 may advantageously be provided, extending inwardly from the front section 40, the purpose of which will be explained below. Displaced approximately 180° from the locking plate engagement finger 48 is a downwardly-extending vertical projection 50, which stabilizes the can 12 when the device 10 is attached to it.

The rim engagement element 22 has an exterior peripheral surface that advantageously includes one or more camming surfaces 52, at least one of which extends downwardly to a short, outwardly-extending projection 54. The exterior peripheral surface forms a substantially annular horizontal shoulder 56. Extending outwardly from the shoulder 56, a short distance rearwardly from the slot 46, is a short horizontal projection 58 that helps guide the locking ring 38 into its locking position from its released position. The shoulder 56 may also be provided with one or more vertically-extending, wedge-shaped projections 60, a first one of which is located adjacent the gap 24, on the opposite side of the gap 24 from the second horizontal projection 58, and another of which may be located a short distance circumferentially from the first one. The wedge-shaped projections 60 also help guide the movement of the locking ring 38, and, in addition, they tend to retain the locking ring 38 in its released position until it is manually forced into its locking position.

Figure 5A:
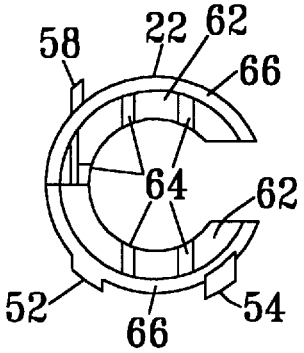
FIG. 5A is a cross-sectional view taken along line 5A—5A of FIG. 5.
Figure 10:
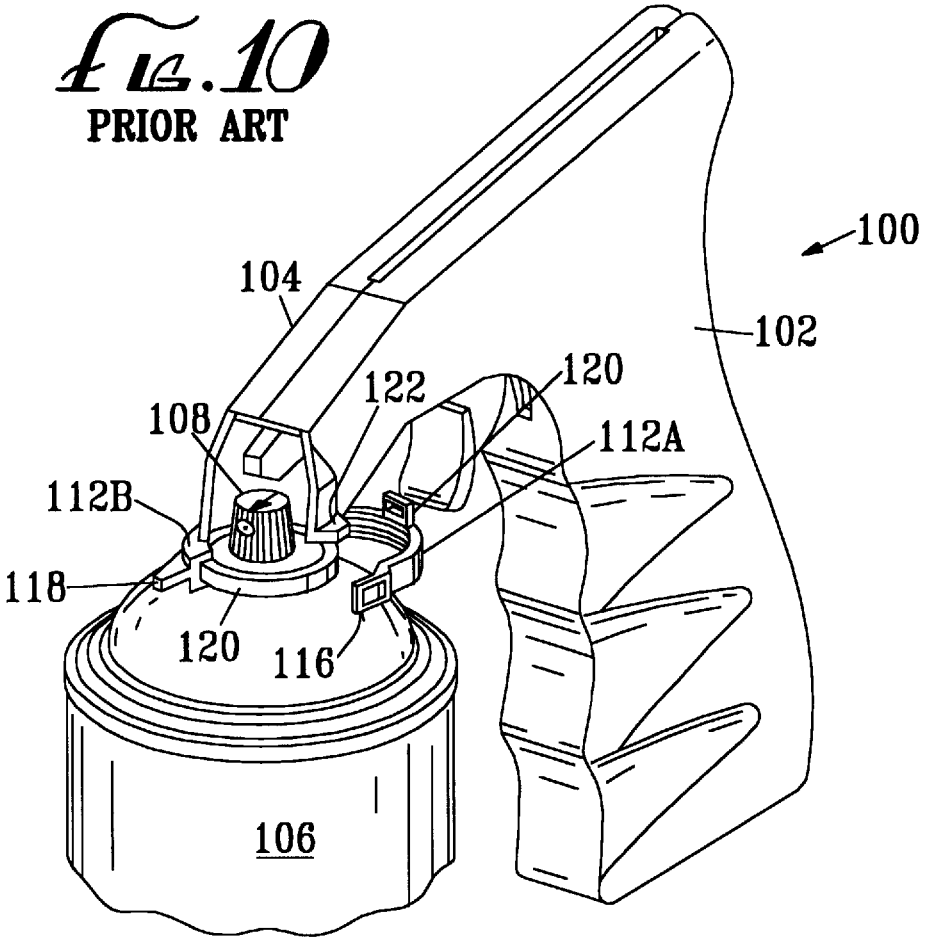
FIG. 10 PRIOR ART
FIG. 10 is a perspective view of a spray can holding and actuation device incorporating a prior art can attachment mechanism, as described above, showing the device attached to a typical spray can.

As shown in FIG. 5A, the segments 22*a*, 22*b* of the rim engagement element 22 define an interior surface 62 that is dimensioned to engage the exterior of the rim 26. The interior surface 62 may advantageously have one or more inwardly-extending projections 64 that abut against the top of the rim 26 to stabilize the can 12 when the device 10 is attached to it. Further enhancing the securing and stabilizing functions is an inwardly-extending peripheral lip 66, around the bottom of the rim engagement element 22, which is engageable with the underside of the rim 26 when the device 10 is attached to the can 12.

In the preferred embodiment of the present invention, actuation lever locking means are provided for selectively locking the valve actuation lever 30 in a position disengaged from the valve 14. These lever locking means include a locking plate 72 that comprises a substantially horizontal base portion 74, an intermediate portion 76 joined to the base portion 74 at a slightly obtuse angle, and an upper portion 78 joined to the intermediate portion 76 at an obtuse angle. The upper portion 78 is bifurcated by a slot 80. The upper edge of the upper portion 78 is provided with a pair of outwardly extending pivot pins 82, advantageously of different diameters, that are registrable and engageable with a pair of similarly-sized apertures in the two opposed side walls of the forward portion 20 of the body 16, on opposite sides of the opening 28. The asymmetrical sizes of the pivot pins 82, and of their associated apertures, facilitate the proper orientation of the plate 72 during assembly.

With the pivot pins 82 engaged in their associated apertures, the plate 72 is mounted for pivotal movement in a substantially vertical plane into and out of the opening 28. When the plate 72 is pivoted upwardly out of the opening 28, it is in an unlocked position, wherein the disk 32 on the free end of the actuation lever 30 is allowed to come into operable engagement with the push-button valve 14 when the trigger 36 is pressed. When the plate 72 is pivoted downwardly into the opening 28, it is in a locked position, in which the free end of the actuation lever 30 is received in the notch 80 and is thereby restrained from further movement. In this manner, the actuation lever 30 is locked in a position with its free end disengaged from the valve 14.

An advantageous feature of the above described actuation lever locking mechanism is that when the plate 72 is moved downwardly, it acts as a shield to block the spray from the valve 14, should the free end of the actuation lever 30 somehow fail to be received in the notch 80. Another advantage of the above-described arrangement is that the locking plate 72 is pivoted upwardly a short distance toward its unlocked position by the locking plate engagement finger 48 on the locking ring 38 when the locking ring 38 is moved from its locking position to its released position, thereby facilitating the removal of the actuation and holding device 10 from the can 12.

The device 10 may also advantageously be provided with a pair of inwardly-extending projections or detents 84 (one of which is shown in FIG. 1), formed on the interior surfaces of the opposed side walls of the forward portion 20 of the body 16, adjacent the pivot pin apertures. These detents 84 are dimensioned so as to provide a slight frictional engagement against the sides of the plate 72. This frictional engagement requires the application of a slight pressure to urge the locking plate 72 downward to its locked position, and upward to its unlocked position, thereby providing a detent mechanism that substantially reduces the likelihood that the locking plate 72 will inadvertently move from its unlocked position to its locked position or from its locked position to its unlocked position.

Figure 7:
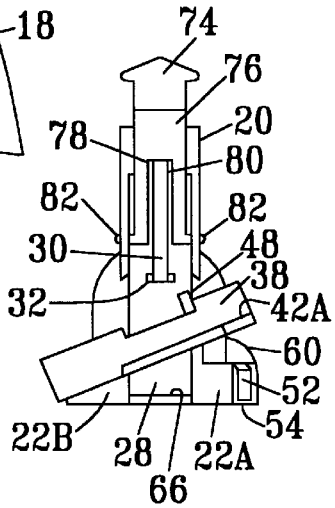
FIG. 7 is a front elevational view, taken along line 7—7 of FIG. 6.

The operation of the actuation and holding device 10 is illustrated in FIGS. 6 through 9. Referring first to FIGS. 6 and 7, with the locking plate 72 flipped up to its unlocked position, the locking ring 38 is shown in its released position, partially displaced from the rim engagement element 22, and defining a plane that is non-coplanar with the plane defined by the rim engagement element 22. With the locking ring 38 held in this released position by the wedge-shaped projections 60, the device 10 is brought into engagement with the rim 26 of the can 12. While the locking ring 38 partially engages at least one of the rim engagement element segments 22*a*, 22*b*, this engagement does not result in any significant compression of the rim engagement element 22. Consequently, at this point in the attachment process, the body halves 16*a*, 16*b*, being joined at the hinge 16*c*, are permitted to spread apart slightly from each other at the front portion 20 to allow the rim engagement segments 22*a*, 22*b* to fit loosely around the outside of the rim 26.

Figure 8:
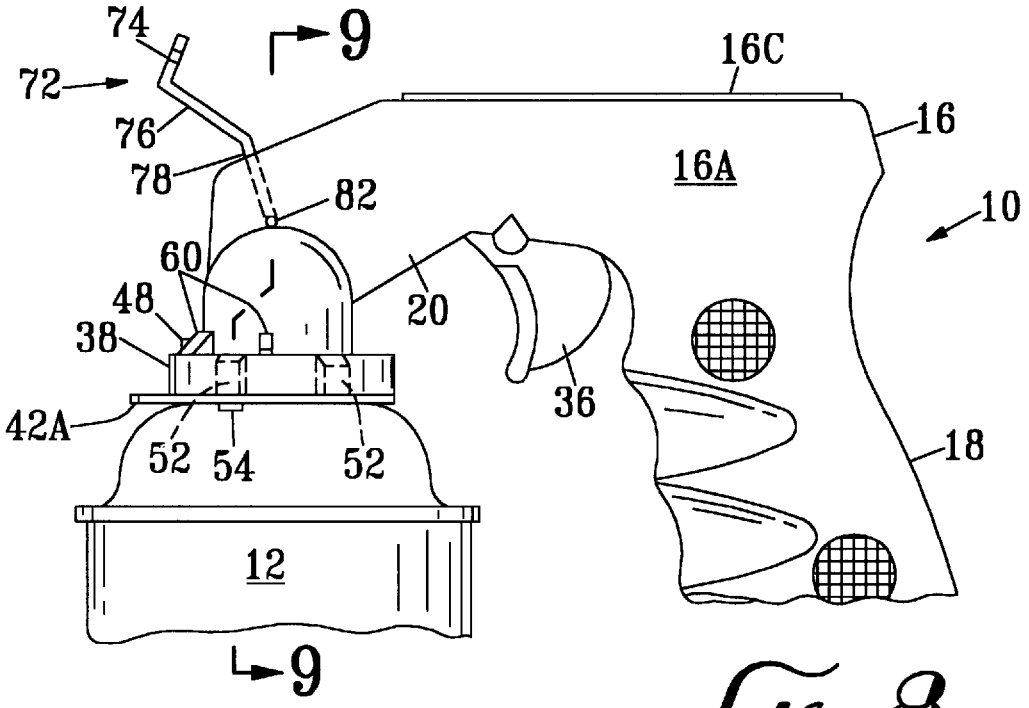
FIG. 8 is left side elevational view, similar to that of FIG. 6, showing the device attached to a spray can.

As shown in FIGS. 8 and 9, the locking ring 38 is then moved downwardly into its locking position, substantially coplanar with the plane defined by the ring engagement element 22, and fully encompassing the exterior peripheral surface of the rim engagement segments 22*a*, 22*b*. This downward movement is facilitated, as mentioned above, by the short horizontal projection 58 and the wedge-shaped projections 60. As the locking ring 38 is thus moved downwardly, it engages against the camming surfaces 52, and the camming action that thereby results causes the rim engagement segments 22*a*, 22*b* to be pressed toward each other, thereby clamping against the rim 26 with sufficient force to effect a secure attachment to it. The locking plate 72 may then be flipped down to its locked position until the contents of the can 12 are ready to be dispensed, at which point it is flipped back up to its unlocked position.

The downward movement of the locking ring 38 is limited by the outward projection 54 on the rim engagement element 22, which (along with the engagement between the prongs 44 and the slot 46) also prevents the locking ring 38 from slipping off of the device 10.

When it is desired to remove the device 10 from the can 12, the locking ring 38 is moved to its released position. The rim engagement segments 22*a*, 22*b* then resiliently spring back to their original positions, in which they only loosely surround the rim 26, as described above. The device 10 is then simply separated from the can 12. As mentioned above, this separation is facilitated by the locking plate engagement finger 48, which displaces the locking plate a short distance upwardly to provide some clearance between it and the rim engagement element 22.

The ability of the rim engagement segments 22*a*, 22*b* to be selectively clamped against the rim 26 and released from it is largely provided by the integral hinge 16*c* and the lack of any mechanical connection between the body halves 16*a*, 16*b* at the front portion 20 of the body 16. These two features allow the rim engagement segments 22*a*, 22*b* to separate sufficiently from each other to allow them to be easily located around the rim 26 and to be easily removed therefrom when the locking ring 38 is in its released position, and to be pressed more closely together by the compressive force applied by the locking ring 38 as it moves to its locking position. This "clamshell" closing action thus gives the device 10 a very secure grip on the rim 26, while allowing a quick release when the compressive force is removed by returning the locking ring 38 to its released position.

From the foregoing description, it can be seen that the present invention offers a distinct advantage over the current state of the art, in that an easier and yet more secure attachment of the actuation and holding device 10 to the container or can 12 is achieved by the unique and novel structure described above. The enhanced security of attachment is achieved in a manner entirely consistent with conventional injection molding techniques, without adding significantly to the cost of manufacturing the current types of can holding and actuation devices.

Although a preferred embodiment has been described herein, variations and modifications of this embodiment will suggest themselves to those skilled in the pertinent arts. Thus, the specific configurations of the rim engagement element 22 and the locking ring 38 disclosed herein are exemplary only. The central operational principle of the invention is the "clamshell" closing action of the two rim engagement segments 22*a*, 22*b*, provided by the integral hinge 16*c* and the lack of attachment between the body halves 16*a*, 16*b* at the forward portion 20 of the body 16, as explained above. This principle can be broadly realized by the use of a first element, divided into opposed segments that together circumscribe a substantial portion of the rim, and a second element that selectively urges the segments of the first element resiliently into a secure engagement with the rim. It will therefore be appreciated that the same operational principle can be realized with a wide variety of configurations for these components, other than those specifically described herein. For example, means may be provided (such as camming surfaces either on the rim engagement element or on the locking ring) for allowing a rotational movement (rather than a vertical movement) of the locking ring between its released and locking positions. Alternatively, the selective compression and release of the rim engagement segments may be effected by structures other than the locking ring 38 described herein, such as a clasp mechanism, for example. Such variations should be considered within the spirit and scope of the present invention, as defined in the claims that follow.

What is claimed is:

1. An actuation device for holding a pressurized container and actuating a push-button valve in the top of the container to dispense the contents thereof, the container having an annular rim around the valve, the device having a forward portion and an actuation member in the forward portion that is engageable with the valve for the actuation thereof, wherein the improvement comprises:

a resiliently flexible rim engagement element, fixed to the forward portion, and having a relaxed state in which it is dimensioned to fit loosely around a substantial portion of the circumference of the rim; and a locking element that is selectively movable between a first position having a noncompressing relationship with the rim engagement element and a second position in which it resiliently compresses the rim engagement element against the rim to effect an attachment therebetween.

2. The device of claim 1, wherein the rim engagement element comprises a substantially annular element having an interior surface that is engageable against the rim, and an exterior surface against which the locking element is selectively engageable.

3. The device of claim 2, wherein the locking element includes a substantially annular portion with an inside diameter that is slightly larger than the outside diameter of the rim engagement element, and wherein the exterior surface of the rim engagement element includes a camming surface against which the locking element is engageable when the locking element is moved to its second position, whereby the engagement between the locking element and the camming surface results in a camming action that resiliently presses the rim engagement element into a clamping engagement with the rim.

4. The device of claim 1, wherein the rim engagement element and the locking element are interconnected so as to prohibit significant rotation of the locking element relative to the rim engagement element.

5. The device of claim 4, wherein the rim engagement element includes a peripheral wall with an aperture therein, and wherein the locking element includes a substantially annular interior wall surface with a prong extending radially inwardly therefrom and located so as to be received in the aperture.

6. The device of claim 1, further comprising means on the rim engagement element for guiding the locking element in its movement from the first position to the second position.

7. The device of claim 6, wherein the rim engagement element includes a substantially annular horizontal shoulder, and wherein the means for guiding includes a projection extending from the shoulder.

8. The device of claim 7, wherein the means for guiding includes a horizontally-extending projection and a vertically-extending projection.

9. The device of claim 1, wherein the locking element, in its first position, defines a plane that is non-coplanar with the plane defined by the rim engagement element, and in its second position, lies substantially coplanar with the plane defined by the rim engagement element so as to surround the rim engagement element.

10. An actuation device for holding a pressurized container and actuating a push-button valve in the top of the container to dispense the contents thereof, the container having an annular rim around the valve, the device having a forward portion and an actuation member in the forward portion that is engageable with the valve for the actuation thereof, wherein the improvement comprises:

a resiliently flexible rim engagement element, fixed to the forward portion, and having a relaxed state in which it is dimensioned to fit loosely around a substantial portion of the circumference of the rim, the rim engagement element having an exterior surface, and an interior surface that is engageable against the rim;

a locking element that is selectively movable between a first position in which it is non-coplanar with the plane defined by the rim engagement element, and a second position in which it substantially surrounds and is substantially coplanar with the rim engagement element; and a camming surface on the exterior surface of the rim engagement element against which the locking element is engageable when it is moved from its first position to its second position, whereby the engagement between the locking element and the camming surface results in a camming action that resiliently presses the rim engagement element into a clamping engagement with the rim.

11. The device of claim 10, wherein the rim engagement element is substantially annular, and wherein the locking element includes a substantially annular portion with an inside diameter that is slightly larger than the outside diameter of the rim engagement element.

12. The device of claim 10, wherein the rim engagement element and the locking element are interconnected so as to prohibit significant rotation of the locking element relative to the rim engagement element.

13. The device of claim 12, wherein the rim engagement element includes a peripheral wall with an aperture therein, and wherein the locking element includes a substantially annular interior wall surface with a prong extending radially inwardly therefrom and located so as to be received in the aperture.

14. The device of claim 10, further comprising means on the rim engagement element for guiding the locking element in its movement from the first position to the second position.

15. The device of claim 14, wherein the rim engagement element includes a substantially annular horizontal shoulder, and wherein the means for guiding includes a projection extending from the shoulder.

16. The device of claim 15, wherein the means for guiding includes a horizontally-extending projection and a vertically-extending projection.

17. An actuation device for holding a pressurized container and actuating a push-button valve in the top of the container to dispense the contents thereof, the container having an annular rim around the valve, the device having a forward portion and an actuation member in the forward portion that is engageable with the valve for the actuation thereof, wherein the improvement comprises:

an opposed pair of resiliently flexible rim engagement segments, fixed to the forward portion, and having a relaxed state in which they fit loosely around the rim, the rim engagement segments defining an exterior surface, and an interior surface that is engageable against the rim; and a locking element that is selectively movable between a first position having a noncompressing relationship with the rim engagement segments and a second position in which it resiliently presses the rim engagement segments toward each other and against the rim to effect an attachment between the rim engagement segments and the rim.

18. The device of claim 17, wherein the rim engagement segments define a substantially annular element, and wherein the locking element includes a substantially annular portion with an inside diameter that is slightly larger than the outside diameter of the substantially annular element.

19. The device of claim 17, further comprising a camming surface on the exterior surface of one of the rim engagement segments, against which the locking element is engageable when the locking element is in its second position, whereby the engagement between the locking element and the camming surface results in a camming action that resiliently presses the rim engagement segments toward each other until the interior surface defined by the rim engagement segments is attachably engaged with the rim.

20. The device of claim 17, wherein one of the rim engagement segments and the locking element are interconnected so as to prohibit significant rotation of the locking element relative to the rim engagement segments.

21. The device of claim 20, wherein one of the rim engagement segments includes a peripheral wall with an aperture therein, and wherein the locking element includes a substantially annular interior wall surface with a prong extending radially inwardly therefrom and located so as to be received in the aperture.

22. The device of claim 17, further comprising means one of the rim engagement segments for guiding the locking element in its movement from the first position to the second position.

23. The device of claim 22, wherein the rim engagement segments define a substantially annular horizontal shoulder, and wherein the means for guiding includes a projection extending from the shoulder.

24. The device of claim 23, wherein the means for guiding includes a horizontally-extending projection and a vertically-extending projection.

25. The device of claim 17, wherein the locking element, in its first position, defines a plane that is non-coplanar with the plane defined by the rim engagement segments, and in its second position, lies substantially coplanar with the plane defined by the rim engagement segments so as to surround the rim engagement segments.

26. An actuation device for holding a pressurized container and actuating a push-button valve in the top of the container to dispense the contents thereof, the container having an annular rim around the valve, the device comprising a body formed of two body halves folded together along an integral hinge and defining a forward portion, and an actuation member in the forward portion that is engageable with the valve for the actuation thereof, wherein the improvement comprises:

a rim engagement element fixed to the forward portion and comprising a pair of opposed segments, each of which is a part of one of the body halves, and having a relaxed state in which they fit loosely around a substantial portion of the circumference of the rim; and a locking element that is selectively movable between a first position having a noncompressing relationship with the rim engagement element and a second position in which it resiliently compresses the rim engagement element segments toward each other and against the rim to effect an attachment therebetween.

27. The device of claim 26, wherein the rim engagement element segments form a substantially annular element having a circumferential gap, the annular element defining an interior surface that is engageable against the rim and an exterior surface against which the locking element is selectively engageable.

28. The device of claim 27, wherein the locking element includes a substantially annular portion with an inside diameter that is slightly larger than the outside diameter of the annular element, and wherein the exterior surface of the annular element includes a camming surface against which the locking element is engageable when the locking element is moved to its second position, whereby the engagement between the locking element and the camming surface results in a camming action that resiliently presses the rim engagement element segments toward each other so as to be attachably engaged against the rim.

29. The device of claim 26, wherein the rim engagement element and the locking element are interconnected so as to prohibit significant rotation of the locking element relative to the rim engagement element.

30. The device of claim 29, wherein the rim engagement element includes a peripheral wall with an aperture therein, and wherein the locking element includes a substantially annular interior wall surface with a prong extending radially inwardly therefrom and located so as to be received in the aperture.

31. The device of claim 26, further comprising means on the rim engagement element for guiding the locking element in its movement from the first position to the second position.

32. The device of claim 31, wherein the rim engagement element includes a substantially annular horizontal shoulder, and wherein the means for guiding includes a projection extending from the shoulder.

33. The device of claim 32, wherein the means for guiding includes a horizontally-extending projection and a vertically-extending projection.

34. The device of claim 26, wherein the locking element, in its first position, defines a plane that is non-coplanar with the plane defined by the rim engagement element, and in its second position, lies substantially coplanar with the plane defined by the rim engagement element so as to surround the rim engagement.

* * * * *